United States Patent [19]

Klotz et al.

[11] 4,402,811

[45] Sep. 6, 1983

[54] HYDROCHLORIC ACID ELECTROLYTIC CELL FOR THE PREPARATION OF CHLORINE AND HYDROGEN

[75] Inventors: Helmut Klotz, Bergisch-Gladbach; Ernst Tepe, Lengerich; Lothar Sesterhenn, Dormagen, all of Fed. Rep. of Germany

[73] Assignee: Bayer Aktiengesellschaft, Leverkusen, Fed. Rep. of Germany

[21] Appl. No.: 313,080

[22] Filed: Oct. 19, 1981

[30] Foreign Application Priority Data

Nov. 6, 1980 [DE] Fed. Rep. of Germany ..... 3041897

[51] Int. Cl.[3] ..... C25B 9/00; C25B 11/02

[52] U.S. Cl. ..... 204/256; 204/268; 204/270

[58] Field of Search ..... 204/254–256, 204/268, 270, 128

[56] References Cited

U.S. PATENT DOCUMENTS

| | | | |
|---|---|---|---|
| 3,242,065 | 3/1966 | De Nora et al. | 204/256 |
| 3,654,120 | 4/1972 | Messner | 204/255 |
| 3,855,104 | 12/1974 | Messner | 204/256 X |
| 3,875,040 | 4/1975 | Weltin et al. | 204/267 |
| 4,013,537 | 3/1977 | White | 204/256 |
| 4,056,452 | 11/1977 | Campbell | 204/258 |
| 4,210,511 | 7/1980 | Campbell et al. | 204/256 |
| 4,236,983 | 12/1980 | Minz et al. | 204/256 X |
| 4,256,554 | 3/1981 | Bjorkman, Jr. | 204/258 |

*Primary Examiner*—Donald R. Valentine

*Attorney, Agent, or Firm*—Sprung, Horn, Kramer & Woods

[57] ABSTRACT

In an electrolytic cell for the production of chlorine and hydrogen from hydrochloric acid, the cell comprising a plurality of spaced bipolar electrodes each provided with vertical grooves for the passage of gas, and a plurality of diaphragms each subdividing the space between adjacent electrodes, the improvement which comprises providing the grooves with a depth of about 18 to 35 mm at least in the upper part of the electrodes. Advantageously the grooves have a width of about 2 to 3 mm and the spacing between adjacent grooves of each electrode is about 4 to 6 mm, the depth of the grooves at their bottoms is about 12 to 15 mm and increases in upward direction to about 20 to 30 mm, and the distance between the electrodes and the diaphragms is from about 0.05 to 1 mm. The voltage drop and energy consumption are less than with different groove configurations and the chlorine content of the hydrogen gas is reduced.

5 Claims, 6 Drawing Figures

HYDROCHLORIC ACID ELECTROLYTIC CELL FOR THE PREPARATION OF CHLORINE AND HYDROGEN

This invention relates to an electrolytic cell for the electrolysis of hydrochloric acid and in particular to an electrolytic cell with bipolar electrodes. Such cells are assembled in the manner of filter presses to form a cell block which may consist of from 30 to 50 individual cells. Graphite electrodes are normally used. Such cells have been described, e.g. in U.S. Pat. No. 3,875,040.

In the past, many attempts have been made to reduce the specific consumption of electrical energy in electrolysis. One important factor which contributes to the increase in electrical resistance is the proportional increase in volume of gas formed during electrolysis, which causes the electrolyte to be constricted into narrow conductive channels between non-conductive gas bubbles. Long ago, it was, therefore, proposed to equip electrode plates with vertical grooves to serve as channels for removing the gas.

It has also been proposed to provide for intermediate degassing (German Pat. No. 28 16 152).

The optimum distance of the electrode from the diaphragm or membrane was regarded as 6 mm at a current density of 4000 $A/m^2$ (Chemie-Ingenieur-Technik, Year 43, 1971, page 169).

In an extensive investigation into the effect of gas bubbles on the electrical resistance between the electrodes, Tobias came to the conclusion that the optimum electrode distance is that at which the average volumetric proportion of gas bubbles in the electrolyte is about 40% (Journal of the Electro Chemical Soc., Vol. 106, 1959, page 836).

It has now been found that the harmful effect of gas bubbles can be considerably reduced if the grooves have a certain depth. It appears that a stable flow is then established in the electrolytic cell, resulting in rapid discharge of the gas bubbles into the grooves.

The present invention therefore provides an electrolytic cell having bipolar electrodes, the electrodes having vertical grooves, and having spaces between the electrodes subdivided by a diaphragm or membrane, for the production of chlorine and hydrogen from hydrochloric acid, characterized in that the grooves have a depth of about 20 to 35 mm, preferably 25 to 32 mm, at least in the upper part of the electrodes.

The grooves preferably have a width of 2 to 3 mm. The lamellae between the grooves are preferably 4 to 6 mm in width. The electrodes according to the invention enable the distance between the electrodes and the diaphragm or membrane to be reduced to about 0.05–2 mm, preferably to below 1 mm, and the voltage between the electrodes is also lower for a given current intensity. This is particularly surprising in view of the fact that according to the known art the increased influence of the gas bubbles would be expected to result in an increase in voltage. Where the diaphragms or membranes have a woven structure, this means that they may be placed directly on the electrode.

The invention will now be described with reference to the accompanying drawings, in which FIG. 1 is a cross-section in the longitudinal direction through a cell block comprising a plurality of electrolytic cells;

Figure 1:
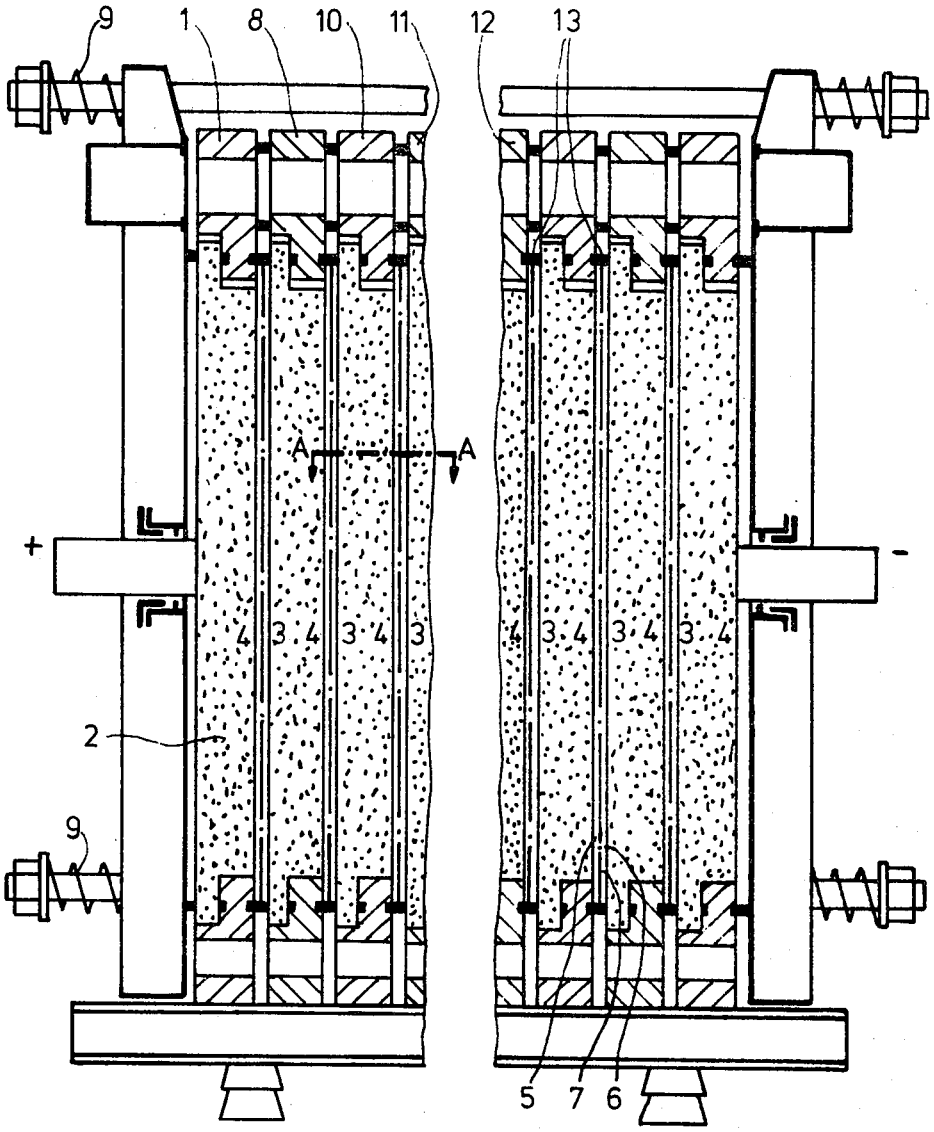

FIG. 1 shows a cell block which may have any number of electrode frames 1,8,10,11,12 in which graphite electrodes 2 are held in position by elastic seals 13. The electrode frames are pressed together by clamping screws 9. Current is supplied to the outer electrodes at + and −. Each electrode acts as anode 4 on one side and as cathode 3 on the other side (bipolar). Each gap between two electrodes is subdivided into an anolyte chamber 5 and a catholyte chamber 6 by a diaphragm or membrane 7. The hydrochloric acid is introduced into each electrolytic cell from below (not shown). The anolyte and catholyte leave at the top through separate channels (not shown) to avoid mixing of the gases produced by electrolysis.

Figure 2:
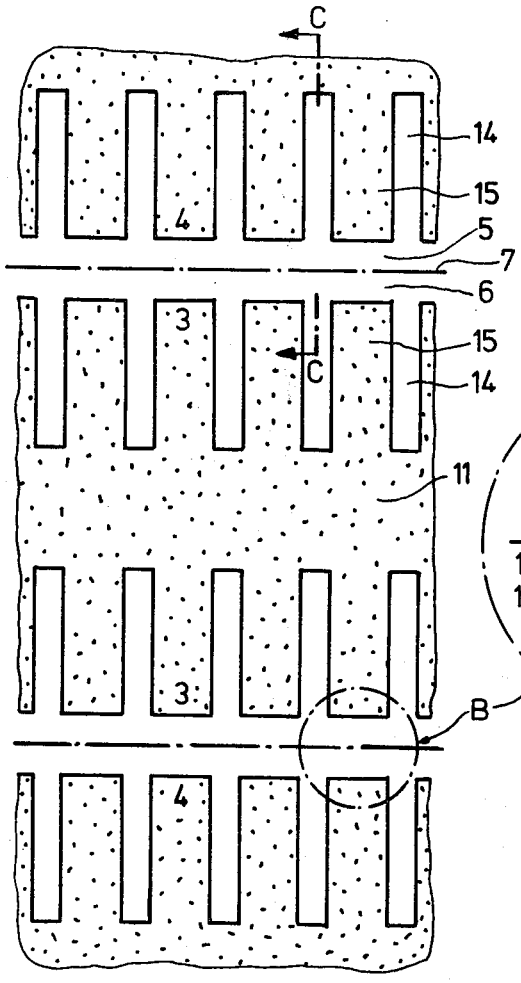
FIG. 2 represents a portion cut out of a cross-section taken through the cell block along the line A—A of FIG. 1.

FIG. 2 shows a portion of a horizontal cross-section through the electrolytic cell. Reference numerals already mentioned above indicate the same parts as in the description of FIG. 1. The drawing shows grooves 14 provided in an electrode 11 and laminar steps 15 between the grooves.

Figure 3:
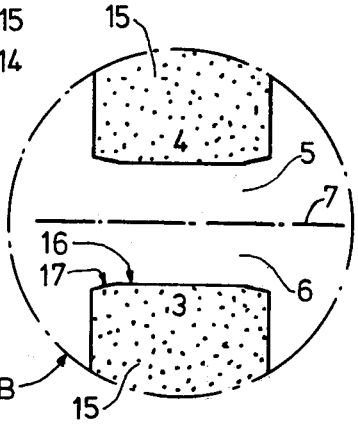
FIG. 3 is an enlarged view of the portion inside the circle B of FIG. 2 of a preferred embodiment.

FIG. 3 is an enlarged view of a detail from FIG. 2 identified as the portion B. In the preferred embodiment illustrated here, the end faces 16 of the steps (lamellae) 15 have flattened or beveled areas 17 near the edges to facilitate transfer of the gas bubbles produced between the electrode steps 15 into the space between the steps formed by the grooves.

Figure 4:
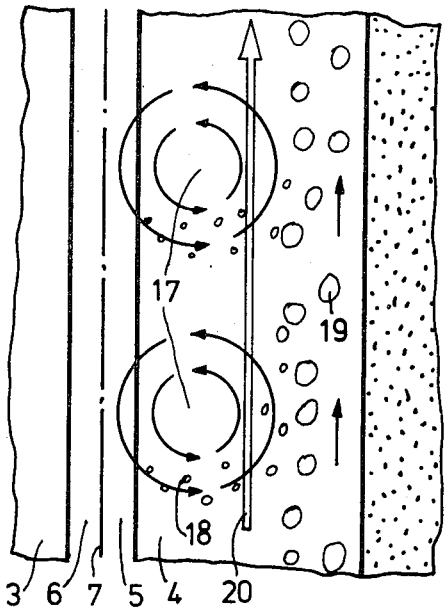
FIG. 4 is a partial cross-section taken on the line C—C of FIG. 2 to illustrate the streams of electrolyte.

FIG. 4 represents an attempt to explain the phenomenon on which the invention is based. It is a sectional view of a portion taken from a vertical section through the electrolytic cell along the line C—C of FIG. 2. An arrow 20 indicates the main direction of flow of electrolyte in the groove. Chlorine is deposited at the anode side of the electrode and bubbles of chlorine gas are formed mainly at the end face of the electrode. These gas bubbles gradually increase in size and become detached when they reach a diameter of from 50 to 100$\mu$. The bubbles of chlorine gas carried along by the hydrochloric acid coalesce to form larger bubbles. It is assumed that eddy currents 17 and 17' are superimposed on the main stream 20 of hydrochloric acid. These eddies ensure that the small gas bubbles 18 are transported from the region near the diaphragm or membrane to the back of the groove, where they coalesce or combine with larger gas bubbles 19 already present there. The velocity of flow of electrolyte is greatest at the back of the groove, where the larger gas bubbles are situated, because in this region the electrolyte is carried along by the ascending gas bubbles. It is assumed that the particular depth of grooves according to the invention favors the formation of stable eddies 17 due to a resonance type of effect. The formation of eddies is favoured by having only a small distance between membrane or diaphragm and electrode since the flow-resistance between diaphragm and electrode is there increased by friction so that the flow of electrolyte is retarded. The distance between electrode and diaphragm or membrane should therefore be less than the width of the grooves.

Figure 5:
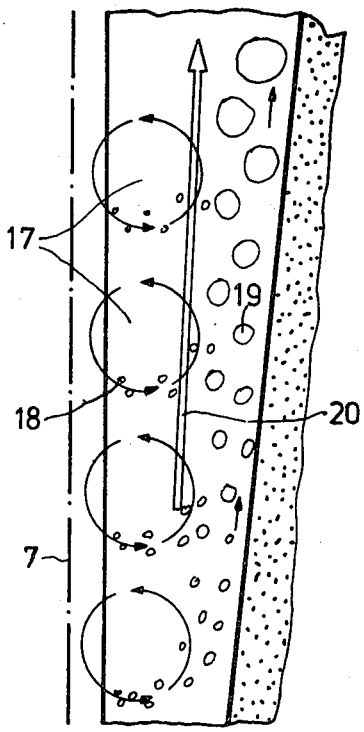
FIG. 5 is a partial cross-section corresponding to FIG. 4 of a preferred embodiment of the invention.

FIG. 5 represents a portion of a vertical section through the electrolytic cell analogous to FIG. 4. It represents an embodiment of an electrode which is preferred to that of FIG. 4. In this case, the depth of the grooves of the electrode increases from below upwards. The depth of the groove may be from 10 to 15 mm near the entrance of electrolyte and may increase to 25–32 mm along the height of the electrode.

It is assumed that the eddies 17, which form naturally, have a diameter of 10 to 15 mm. Since the volumetric proportion of gas in the cell increases along the height of the electrode, a depth of groove approximately equal to the diameter of the eddy is sufficient in the lower part.

The electrolytic cell according to the invention not only provides a considerable saving in specific electrical energy due to the reduced voltage drop but in addition it is surprisingly found that the hydrogen has a lower content of chlorine.

Furthermore, the fluttering of the membrane which is frequently observed when there is a larger distance between electrodes is eliminated, with the result that the life of the membrane is substantially increased.

The invention will now be illustrated in the following examples:

EXAMPLE 1

In an experimental electrolytic cell of height 110 mm having bipolar graphite electrodes and a diaphragm to separate the anolyte and catholyte, hydrochloric acid at an HCl concentration of 20% is introduced from below. The cell is operated at a current density of 5 kA/m$^2$. The temperature of the hydrochloric acid leaving the cell is 80° C. The grooves of the electrodes have a width of 2.5 mm and the steps between them a width of 5 mm. The distance between the electrodes is 6 mm. The material of the diaphragm has a thickness of 0.5 mm. Electrodes with differing depths of grooves are used. The voltage drop measured between the electrodes and the chlorine content of the hydrogen are summarized in Table 1 below.

TABLE 1

| Example | 1a | 1b | 1c | 1d |
|---|---|---|---|---|
| Depth of groove mm | 10 | 14 | 20 | 25 |
| Voltage drop V | 2.015 | 1.955 | 1.835 | 1.785 |
| $Cl_2$ content in $H_2$ vol. −% | 1.1 | 0.3 | 0.2 | 0.2 |

It is found that when the grooves have a depth of 20 to 25 mm in accordance with the invention, the voltage drop is considerably less and the chlorine content in the hydrogen is at the same time also considerably less.

EXAMPLE 2

Under otherwise the same conditions as in Example 1, the electrode distance is reduced to 0.5 mm and the depth of groove is 20 mm. The voltage drop is 1.710 V. The $Cl_2$ content in $H_2$ is 0.2 vol.-%.

Figure 6:
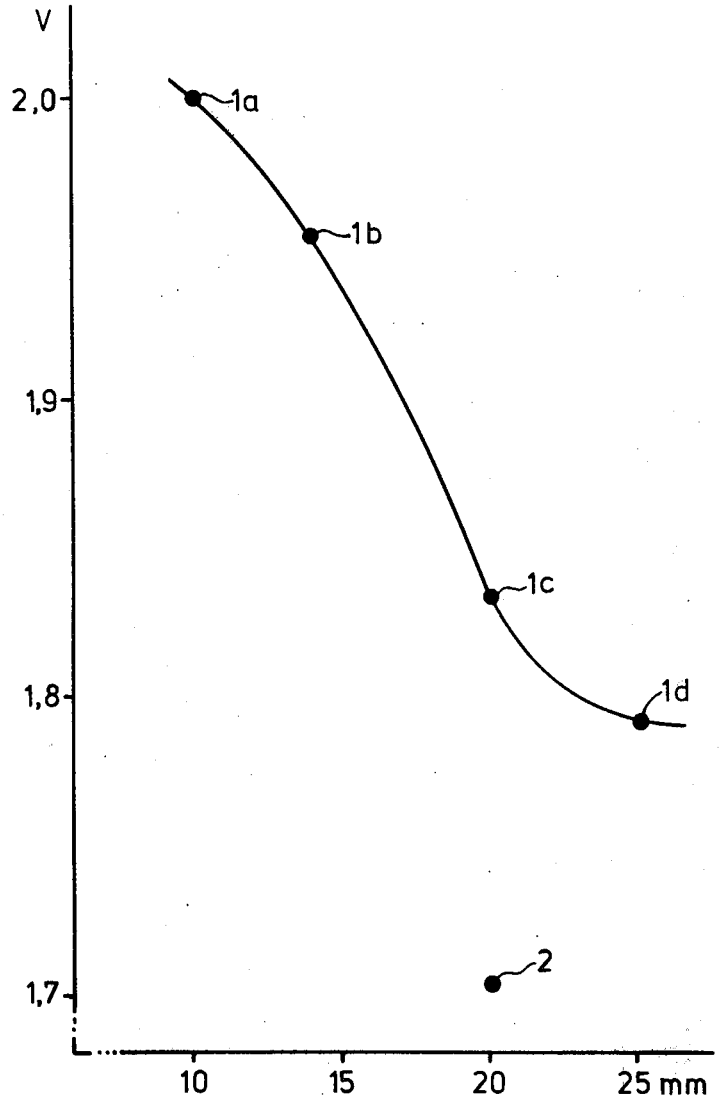
FIG. 6 is a graph showing the relationship between depth of groove and voltage drop.

The relationship between voltage drop and depth of groove is again illustrated in FIG. 6.

It will be appreciated that the instant specification and examples are set forth by way of illustration and not limitation, and that various modifications and changes may be made without departing from the spirit and scope of the present invention.

We claim:

1. In an electrolytic cell for the production of chlorine and hydrogen from hydrochloric acid, the cell comprising a plurality of spaced bipolar electrodes each provided with vertical grooves for the passage of gas, and a plurality of diaphragms each subdividing the space between adjacent electrodes, the improvement which comprises providing the grooves with a depth of about 18 to 35 mm at least in the upper part of the electrodes and with a depth of about 12 to 15 mm at their bottoms.

2. A cell according to claim 1, wherein the grooves have a width of about 2 to 3 mm and the spacing between adjacent grooves of each electrode is about 4 to 6 mm.

3. A cell according to claim 2, wherein the depth of the grooves at their tops is about 20 to 30 mm, and the distance between the electrodes and the diaphragms is from about 0.05 to 1 mm.

4. A cell according to claim 1, wherein the distance between the electrodes and the diaphragms is about 0.05 to 2 mm.

5. A cell according to claim 1, wherein adjacent grooves of an electrode form steps which at their ends are beveled to facilitate transfer of gas bubbles.

* * * * *